US005449106A

United States Patent [19]

Buckley

[11] Patent Number: 5,449,106

[45] Date of Patent: Sep. 12, 1995

[54] TERMINAL STRIP FEED MECHANISM FOR A TERMINAL INSERTION MACHINE

[75] Inventor: Richard A. Buckley, Camp Hill, Pa.

[73] Assignee: The Whitaker Corporation, Wilmington, Del.

[21] Appl. No.: 129,300

[22] Filed: Sep. 29, 1993

[51] Int. Cl.[6] ..... B65H 20/22

[52] U.S. Cl. ..... 226/162

[58] Field of Search ..... 226/162, 158, 67, 68, 226/62, 57, 70, 71, 162, 163, 164; 29/759, 753

[56] References Cited

U.S. PATENT DOCUMENTS

| | | | |
|---|---|---|---|
| 4,043,017 | 8/1977 | Folk et al. | 29/749 |
| 4,306,477 | 12/1981 | Travis | 83/205 |
| 4,385,718 | 3/1983 | Norris | 226/68 |
| 4,881,317 | 11/1989 | Brown | 29/739 |
| 4,912,823 | 4/1990 | Shah et al. | 29/33 |

*Primary Examiner*—Daniel P. Stodola
*Assistant Examiner*—Thomas E. Dunn

[57] ABSTRACT

An intermittent terminal feed mechanism is provide in a machine for attaching terminals to electrical conductors. The terminals are fed, in strip form, along a feed track to a workstation by the intermittent feed mechanism that retracts away from the strip of terminals during the return stroke. The feed mechanism includes a support member that is threaded onto an adjustable coupling that is attached to and carried by the piston rod of a linear actuator. A pawl is pivotally attached at one end to the support member while the other end has a tooth that engages the strip of terminals for feeding. Another linear actuator is attached to the support member and is arranged to pivot the pawl into engagement with the strip of terminals during feeding thereof and out of engagement during the return stroke.

7 Claims, 6 Drawing Sheets

TERMINAL STRIP FEED MECHANISM FOR A TERMINAL INSERTION MACHINE

The present invention relates to automatic machines for performing certain functions such as attaching terminals to electrical conductors, and more particularly to an intermittent feed mechanism in such machines for moving the terminal into position for attachment.

BACKGROUND OF THE INVENTION

Existing machines for terminating the ends of electrical conductors, such as windings of bobbins, must be able to accommodate different styles and types of terminals. In most cases the terminals are supplied in strip form where the terminals are all attached, one to the other, by means of a carrier strip or segments of one. The strip of terminals is usually wound on a reel. The strip of terminals is fed along a guide track and presented to a work station where the lead terminal is severed from the carrier strip by a cutting blade, positioned with respect to an electrical conductor of a component, such as a bobbin, and terminated to the conductor. The actual feeding of the strip of terminals along the track is usually accomplished by means of an intermittent feed mechanism having a pawl that is spring loaded into engagement with the underside of the strip of terminals. The pawl is moved in one direction to advance a terminal into the workstation and then, the pawl is moved in the opposite direction where the end that engages the terminal pivots against the spring while it rides down over the next terminal and snaps up behind it ready to advance this terminal into the workstation. To reduce problems of chatter and other effects that cause misfeeding the spring that biases the pawl into engagement with the terminal is quite strong. Such feed mechanisms are commonly used in machines for applying electrical terminals to conductors. One characteristic of these feed mechanisms is that during the return stroke of the pawl the strip of terminals must be securely held in place to overcome the frictional forces of the pawl tending to move the strip in the reverse direction, and tending to push the terminals upwardly away from their feed track. A spring loaded drag plate must be used to hold the strip of terminals on the feed track and prevent their movement when the feed pawl is retracted. This spring also is quite strong resulting in considerable friction between the drag plate and the strip of terminals. This friction must be overcome by the actuator that drives the feed advance mechanism, thereby requiring a larger actuator than would otherwise be required. What is needed is a terminal feeding mechanism that completely disengages the strip of terminals prior to and during the return stroke of the pawl thereby obviating the need for a drag plate.

SUMMARY OF THE INVENTION

A machine is disclosed for applying a terminal, taken from a strip of terminals, to the end of an electrical conductor in a workstation. The machine includes a feed track arranged so that the strip of terminals is moved along the feed track toward the workstation. A terminal feed mechanism is provided that includes a support member arranged to move in a first direction parallel with the movement of the strip of terminals and in an opposite second direction. A pawl is pivotally attached at one end to the support member and has a terminal engaging tooth at another end thereof. A first actuator means is attached to the frame for effecting the movement of the support member in the first and second directions. A second actuator means is carried by the support member for effecting pivotal movement of the pawl so that the tooth is in engagement with a terminal of the strip of terminals while the first actuator means effects the movement of the support member in the first direction, and for effecting opposite pivotal movement of the pawl so that the tooth disengages the terminal and is spaced from the strip of terminals while the first actuator means effects the movement of the support means in the second direction.

DESCRIPTION OF THE PREFERRED EMBODIMENT

Figure 1:
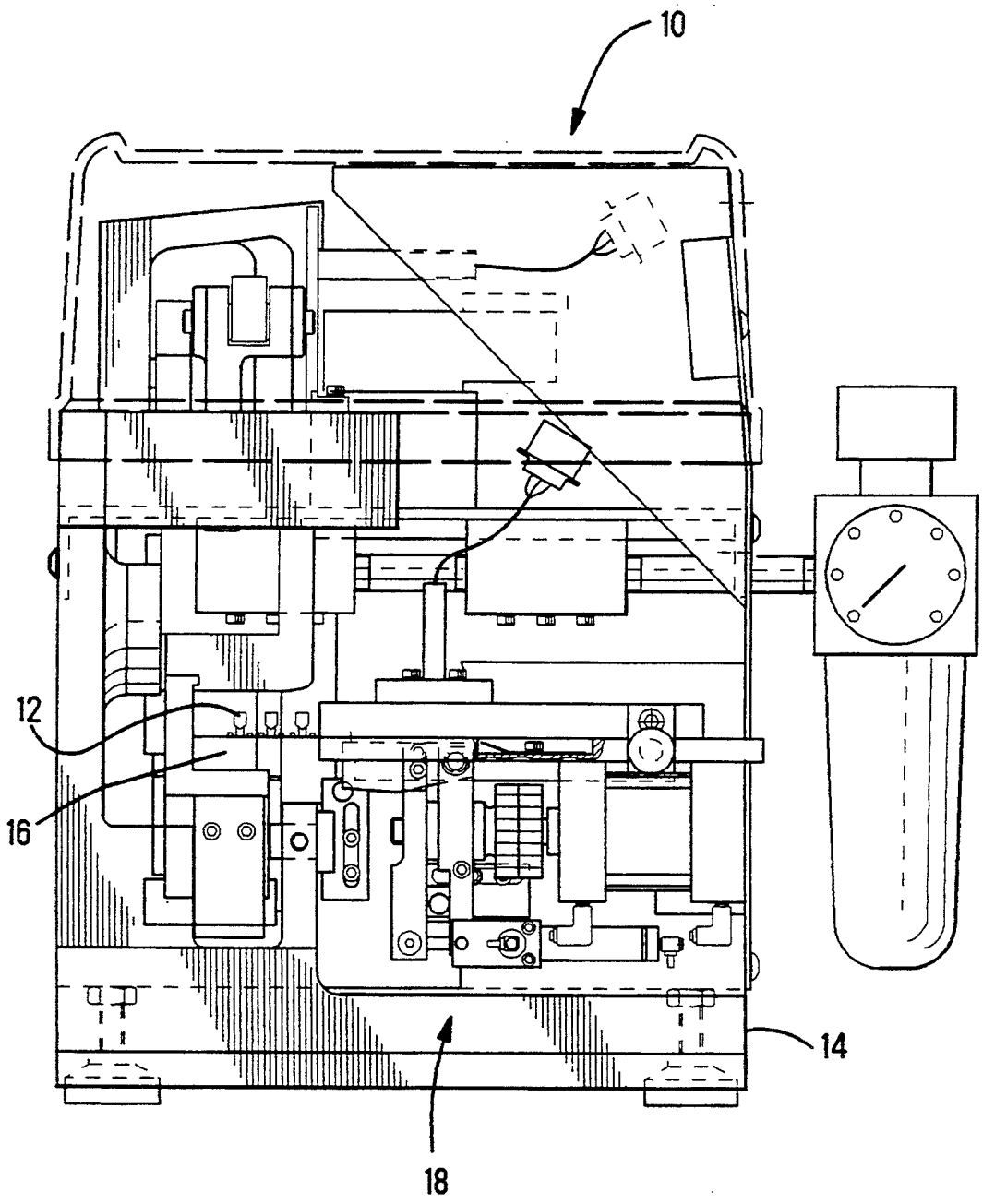
FIG. 1 is a front view of a terminal attachment and insertion machine incorporating the teachings of the present invention.
Figure 2:
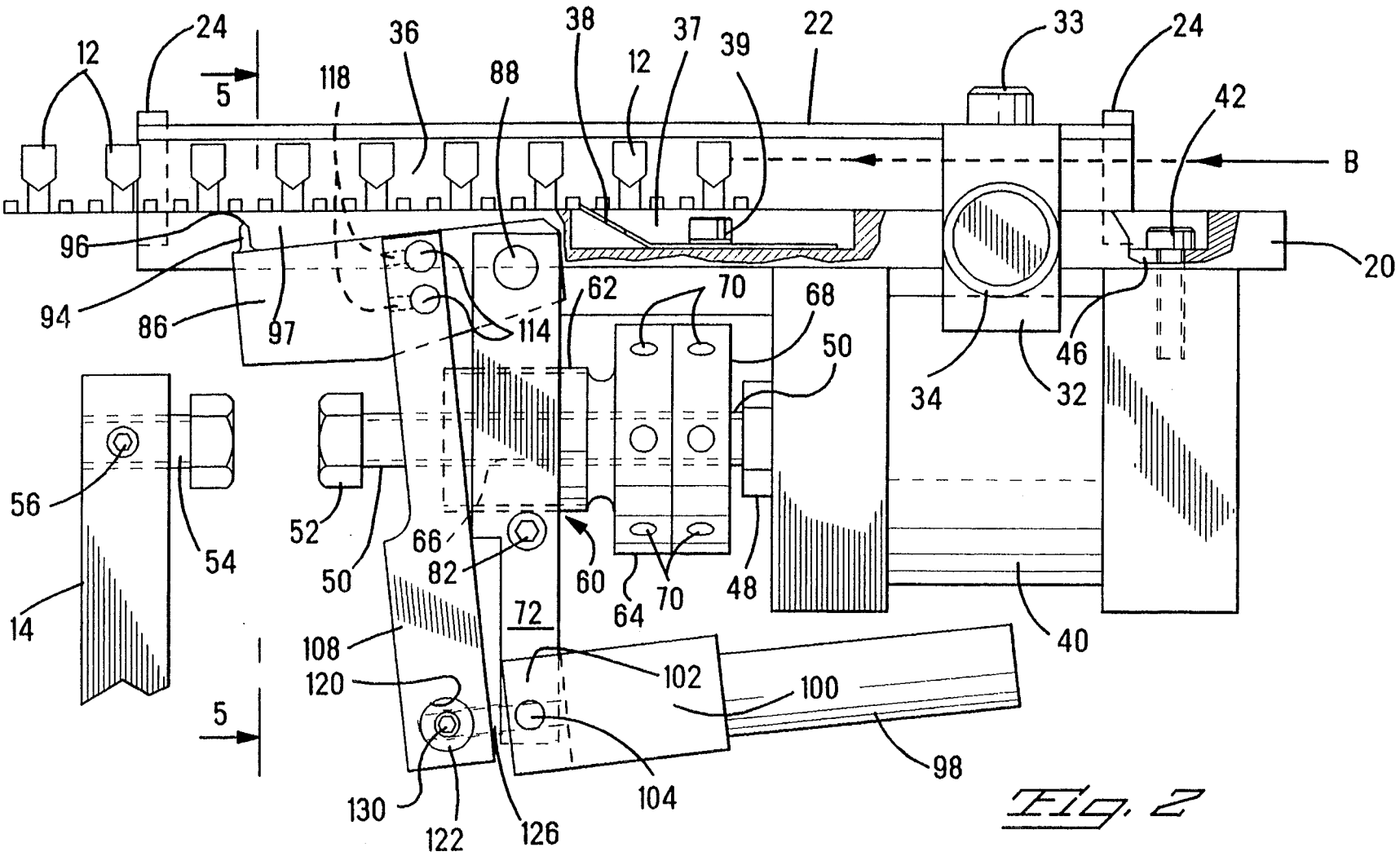
FIG. 2 is an enlarged view of the feed mechanism shown in FIG. 1.
Figure 5:
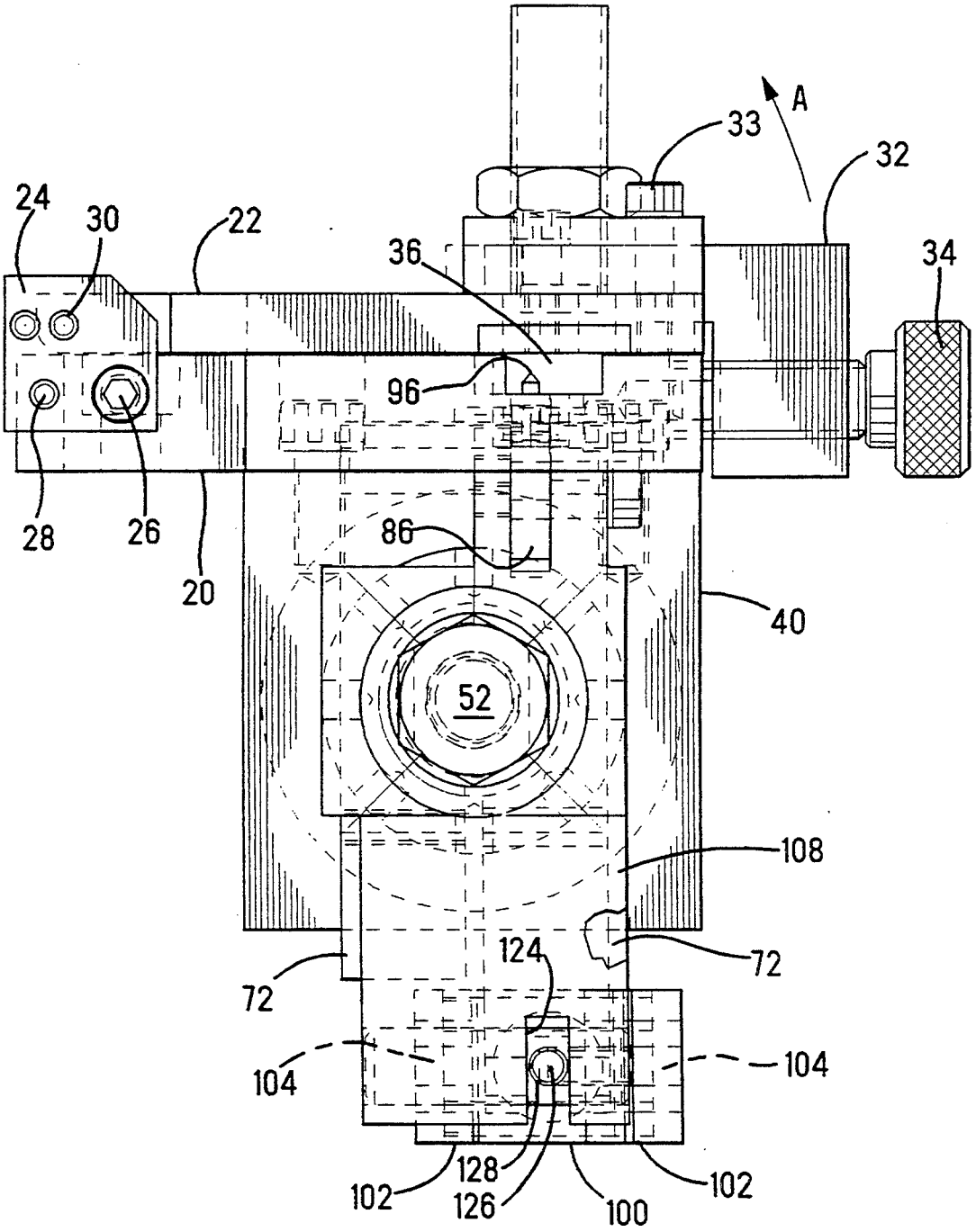
FIG. 5 is a cross-sectional view taken along the lines 5—5 of FIG. 2.

There is shown in FIG. 1 an automatic machine 10 for attaching terminals 12 to the ends of magnet wire wound around a bobbin and inserting the terminal into a cavity in the bobbin housing. The machine includes a frame 14, a workstation 16 containing tooling that is not shown for severing and inserting the terminal, and a terminal feed mechanism 18. The terminal feed mechanism 18 is shown in more detail in FIGS. 2, 3, 4, and 5, and includes a bottom feed plate 20 that is attached to the frame 14 and a top feed plate 22 that is hingedly attached to a rear edge of the bottom feed plate by means of two hinges 24, as best seen in FIGS. 2 and 5. Each of the two hinges are attached to an end of the bottom plate 20 with a screw 26 and dowel pin 28. The top plate 22 is pivotally attached to the hinges 24 by means of a pair of dowel pins 30 so that the top plate is free to swing upwardly in the direction of the arrow A shown in FIG. 5, for a purpose that will be explained. A latch plate 32 is attached to the top surface of the top plate 22 by a screw 33 and has a spring loaded latch pin 34 that is biased inwardly toward the front edge of the bottom plate so that it engages an opening in the edge to hold the top plate in position against the bottom plate. By pulling the latch pin out, against the biasing force of the spring, it disengages the opening in the edge of the bottom plate and is free to swing upwardly. The bottom plate 20 includes a recess 36 having a floor and two sidewalls that form a feed track, as shown in FIG. 2, which directs the strip of terminals 12 toward the workstation 16, as shown in FIG. 1. Another recess 37 is formed in the floor of the recess 36, as best seen in FIG. 2, and contains a light flat spring 38 held in place by a screw 39. The spring has its end tilted upwardly to lightly engage the terminals 12 to prevent movement of the strip of terminals due to vibration of the machine during the return stroke of the feed mechanism 18.

A linear actuator 40, an air cylinder in the present example, is attached to the bottom plate 20 by four screws 42 that extend through four elongated holes 46 formed in the bottom plate and into threaded holes in the air cylinder. The elongated holes 46 permit adjusting the position of the actuator along the direction of feed as indicated by the arrow B. The actuator 40 includes a piston rod 48 that is movable from its fully retracted position shown in FIG. 2 to its fully extended position shown in FIG. 4. A stud or bolt 50 is tightly threaded into the end of the piston rod 48 and extends outwardly along the extended centerline thereof as shown. The bolt 50 terminates at its other end in a head 52. A stop screw 54 is threaded into a hole in the frame 14 in alignment with the centerline of the piston rod 48 and is arranged to abut the head 52 of the bolt 50 when the actuator has extended a desired amount. The position of the stop screw is adjustable by simply screwing it further into or out of the threaded hole. A set screw 56 in the frame 14 is used to lock the stop screw in position. An adjusting member or sleeve 60 having an outer threaded portion 62 and a disc-shaped flange 64 at one end, has an axially disposed threaded hole 66 extending completely therethrough, concentric with the threaded portion 62. The axial hole 66 is in threaded engagement with the threaded bolt 50 so that the sleeve 60 is carried with the bolt when the piston rod 48 is extended or retracted. A locking disc 68 or locknut having an axially disposed threaded hole is in threaded engagement with the bolt 50 adjacent the flange 64 and serves to lock the sleeve 60 in position with respect to the bolt 50. Both the flange 64 and the disc 68 have several radially disposed holes 70 formed in their outer peripheries that are used to insert a tool to aid in tightening them together for locking the sleeve in place or for separate them when adjusting the position of the sleeve 60.

Figure 6:
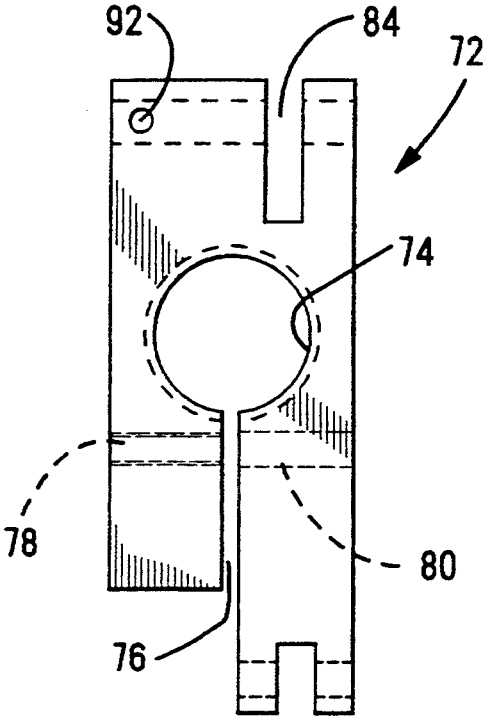
FIGS. 6 and 7 are front and side views, respectively, of the support member shown in FIG. 2.
Figure 7:
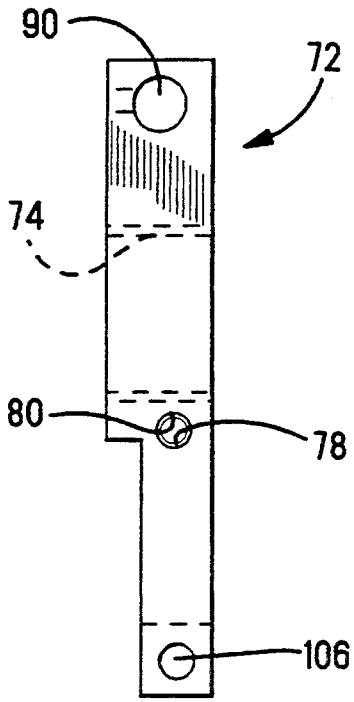

A support member 72, as shown in FIGS. 6 and 7 has a threaded hole 74 that is in threaded engagement with the outer thread 62 of the sleeve 60, as shown in FIG. 2. A slit 76 is formed in the support member 72 and intersects the hole 74. A threaded hole 78 and aligned clearance hole 80 formed in the support member 72 receive a locking screw 82 which may be tightened to lock the support member firmly on the sleeve 60. The threaded hole 74, sleeve 60, and bolt 50, together, form an adjustable coupling that is operable to vary the position of the support member 72 with respect to and along the axis of the actuator 40. A slot 84 is formed in the upper edge of the support member 72 and is sized to be a slip fit with a feed dog 86, as shown in FIG. 2. The feed dog 86 is pivotally attached to the support member 72 by means of a pin 88 that is disposed in a hole 90 formed in the upper or first end of the support member. The pin 88 is held in place by a set screw threaded into a hole 92 that intersects the hole 90. The feed dog 86 is a relatively elongated flat plate having a feed tooth 94 extending upwardly from the end opposite the pivot pin 88, as viewed in FIG. 2. The feed tooth 94 includes a somewhat pointed end 96 for entering the space between adjacent terminals 12 of the strip of terminals. If the terminals are slightly misaligned the pointed end will cam against one of the terminals and bring them into alignment. It will be understood that the shape of the feed tooth 94 is controlled by the type and style of the terminal being used. While in the present example the pointed end 96 is used, in certain other cases a different shape may be appropriate. An opening 97 is formed through the floor of the recess 36 vertically above the support member 72 and extending to the left edge of the bottom plate 20, as viewed in FIG. 2. The upper end of the support member 72 and a portion of the feed dog 86 extend into this opening 97, the walls of which maintain the vertical alignment of the support member. Note that the feed tooth 94 may extend completely through the opening 97 to come into engagement with the terminal 12. The other or second end of the support member 72 supports a feed dog engagement actuator 98, which in the present example is an air cylinder. The actuator 98 has a mounting block 100 at one end thereof having a bifurcated end 102 that straddles the end of the support member. A pin 104 is pressed into a hole formed through the end 102 and through a slip fit hole 106 formed in the end of the support member 72 so that the actuator 98 is free to pivot about the pin 104 but is carried by the support member.

Figure 3:
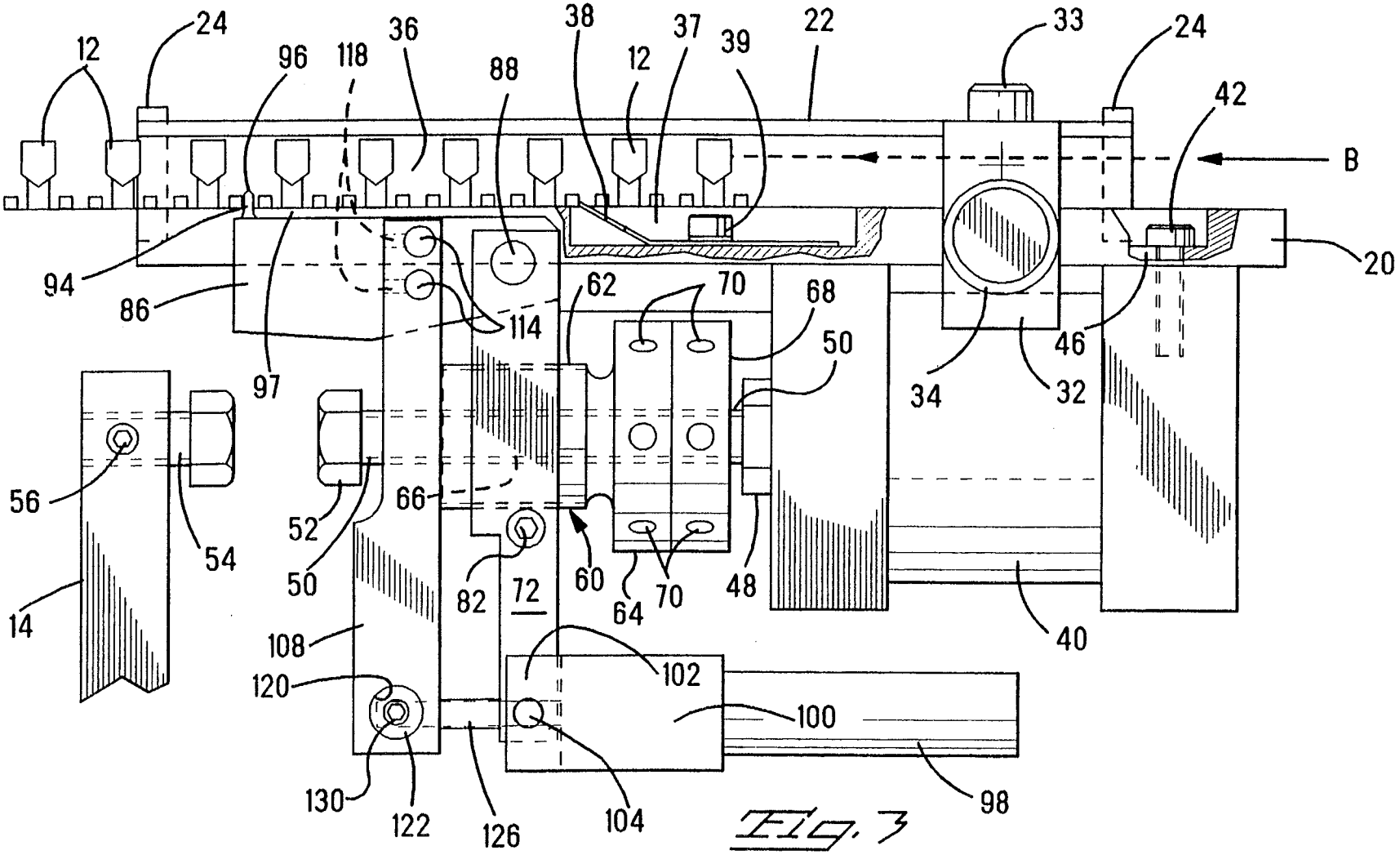
FIGS. 3 and 4 are views similar to that of FIG. 2 showing the feed mechanism in different operating positions.
Figure 4:
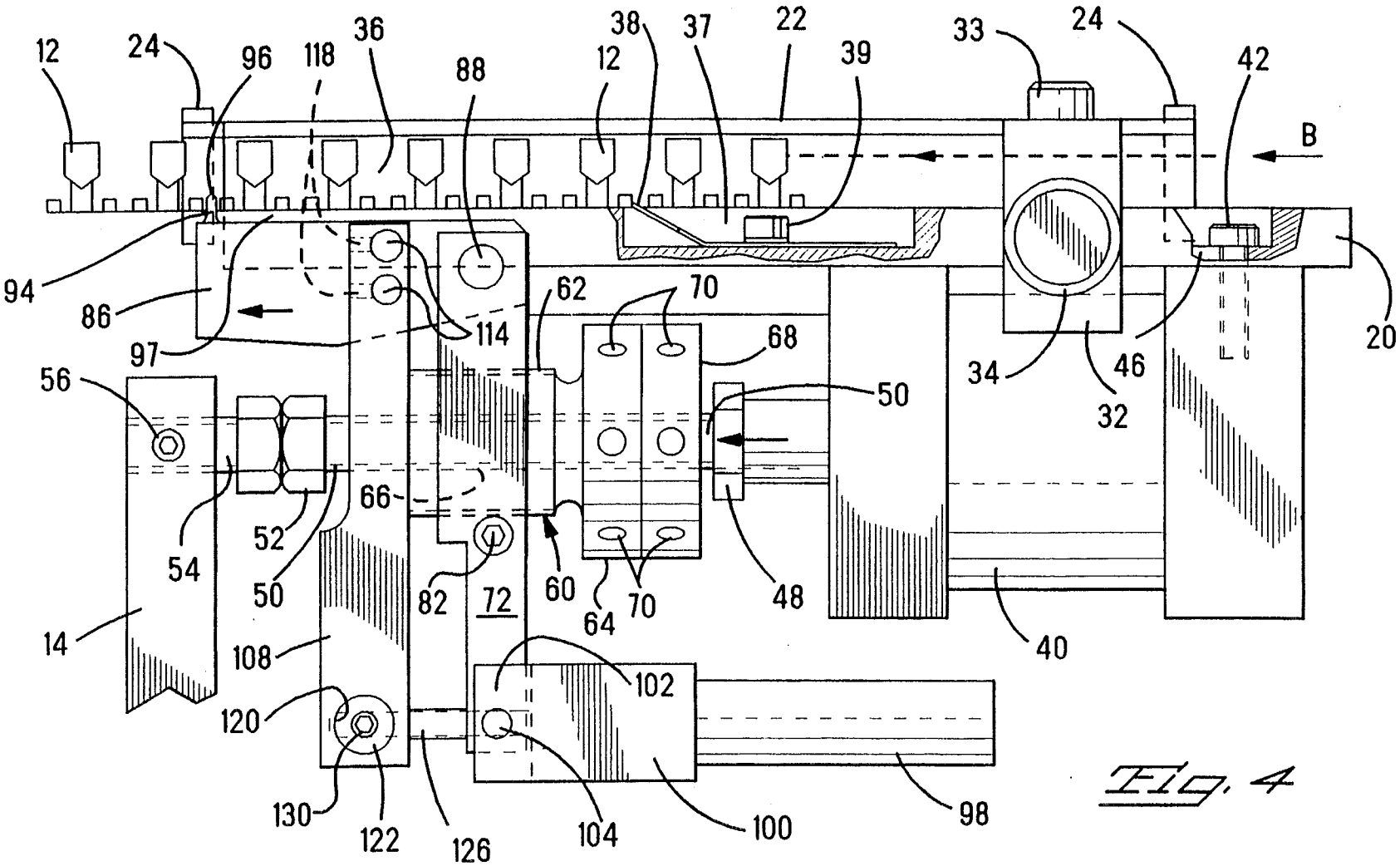
Figure 8:
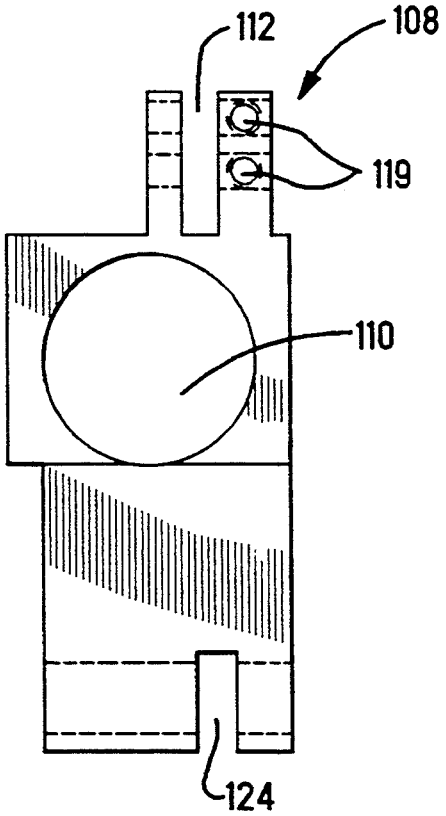
FIGS. 8 and 9 are front and side views, respectively, of the feed dog actuating lever shown in FIG. 2.
Figure 9:
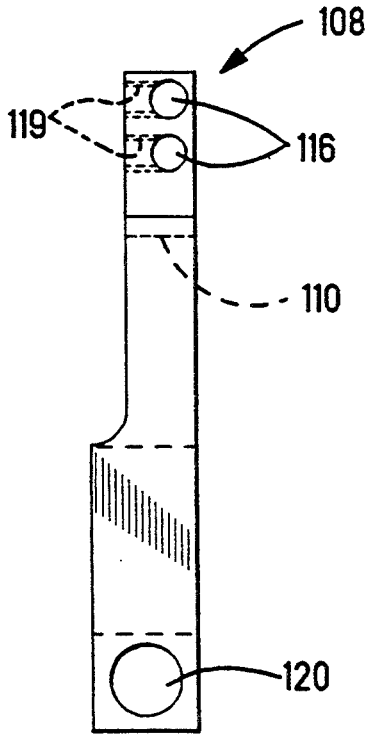

There is shown in FIGS. 8 and 9 a feed dog actuating lever 108 having a clearance opening 110 sized to accommodate the sleeve 60 without interference. The lever 108 has a slot 112 in its upper or first end sized to be a slip fit with the feed dog 86. The feed dog is arranged in the slot, as shown in FIG. 2, and secured there by means of a pair of pins 114 received in two slip fit holes 116 formed in the upper end of the lever. A pair of set screws 118 are threaded into a pair of threaded holes 119 formed in the lever 108 so that they intersect the holes 116. The set screws 118 are tightened to securely attach the lever 108 to the feed dog 86. The other or second end of the lever has a hole 120 perpendicular with the slot 112 for receiving a slip fit pin 122. A slot 124 is formed in the end of the lever 108 intersecting the hole 120 and parallel with the slot 112, and is sized to receive the piston rod 126 therewithin with a small amount of clearance. The pin 122 has a threaded hole 128, shown in FIG. 5 formed perpendicular to its longitudinal axis and in alignment with the slot 124. The end of the piston rod 126 is threaded into the hole 128 and secured in place by a set screw 130 threaded into the end of the pin 122. With this arrangement, when the actuator 98 has retracted its piston rod 126 the feed dog 86 has pivoted counterclockwise so that its feed tooth 94 is well below the strip of terminals 12, as shown in FIG. 2. When the piston rod 126 is extended the feed dog 86 is pivoted clockwise so that the feed tooth 94 enters into the space between two adjacent terminals 12, as shown in FIG. 3.

In operation, the top plate 22 is hinged upwardly, a strip of terminals loaded into the recess 36 so that the end of the strip is in proper alignment with the workstation and the top plate closed and latched in position. Both actuators 40 and 98 have their piston rods fully retracted as shown in FIG. 2. As the machine 10 begins its operating cycle, the piston rod 126 of the actuator 98 is extended so that the feed tooth 94 moves up into engagement with the strip of terminals 12, as shown in FIG. 3. The piston rod 48 of the actuator 40 is then extended causing the support member 72, feed dog 86, and actuator 98 to move in a first direction toward the left thereby advancing the strip of terminals 12 toward the left, as viewed in FIG. 3, until the head 52 of the bolt. 50 abuts the stop screw 54. The first terminal 12 is now in proper position in the workstation where it is severed from the carrier strip and inserted into the bobbin and terminated to the end of the bobbin winding, while the piston rod 48 remains extended. The piston rod 126 is then fully retracted so that the feed dog 86 swings downwardly and clear of the strip of terminals. The piston rod 48 is then fully retracted causing the support member 72, feed dog 86, and actuator 98 to move in a second direction to the right to their starting position shown in FIG. 2. This operating cycle results in the feed tooth 94 moving in a substantially rectangular path where the feed tooth engages the terminal strip only while advancing the terminals toward the workstation and not during the return stroke. The gross position of the fed terminal 12 in the workstation can be adjusted by loosening the screws 42 and sliding the actuator 40 along the elongated holes 46 to the desired position then retightening the screws. Fine adjustment is accomplished by backing the locking disc 68 away from the flange 64, rotating the flange 64 in the appropriate direction to move the feed tooth 94 the desired amount, then tightening the locking disc against the flange again. In the present example, there are 24 threads per inch on the bolt 50 while the outer diameter of the sleeve 60 has 18 threads per inch. This yields an adjusted movement of about 0.014 inch for every revolution of the sleeve 60. It will be understood that these thread sizes may be varied to produce other rates of movement when adjusting the sleeve 60, as may be desired.

An important advantage of the present invention is that the feed dog disengages the strip of terminals prior to and during the return stroke of the feed dog so that there are no forces on the strip of terminals tending to move them out of position in the feed track. This eliminates the need for a conventional drag plate resulting in reduced weight, complexity, and a substantial cost savings. Additionally, since there is no drag plate to impose a retarding force on the strip of terminals during feeding, the actuator 40 may be significantly smaller than would otherwise be required, resulting in an overall weight savings as well as a cost savings.

I claim:

1. In a machine for applying a terminal, taken from a strip of terminals, to the end of an electrical conductor in a workstation, wherein said machine includes a feed track and said strip of terminals is moved along said feed track toward said workstation, a terminal feed mechanism comprising:

(a) a support member arranged to move in a first direction parallel with said movement of said strip of terminals and in an opposite second direction;

(b) a pawl pivotally attached at one end to said support member and having a terminal engaging tooth at another end thereof;

(c) first actuator means attached to said frame for effecting said movement of said support member in said first and second directions, said first actuator means including a pneumatic cylinder having a movable piston and piston rod;

(d) an adjustable coupling operably connected between said piston rod and said support member to vary the position of said support member with respect to and along the axis of said piston rod, said adjustable coupling including:

a first threaded hole formed through said support member having its axis parallel with said movement of said strip of terminals;

an adjusting member having a threaded diameter in engagement with said first threaded hole and a second threaded hole formed concentric with said threaded diameter; and a threaded stud extending through said adjusting member in engagement with said second threaded hole, one end of said stud secured to said piston rod, said coupling being arranged so that when said adjusting member is turned about its axis in one direction said support member is moved away from said first actuator and when turned in the other direction said support member is moved toward said first actuator; and (e) second actuator means carried by said support member for effecting pivotal movement of said pawl so that said tooth is in engagement with a terminal of said strip of terminals while said first actuator means effects said movement of said support member in said first direction, and for effecting opposite pivotal movement of said pawl so that said tooth disengages said terminal and is spaced from said strip of terminals while said first actuator means effects said movement of said support means in said second direction.

2. The machine according to claim 1 including a locknut in threaded engagement with said stud adjacent said adjusting member.

3. The machine according to claim 1 including an adjustable stop screw attached to said frame in axial alignment with said piston rod and wherein the end of said stud opposite said first actuator includes an abutting surface arranged to abuttingly engage said stop screw when said first actuator has moved a terminal into position in said workstation thereby stopping further movement of said piston rod and said support member in said first direction.

4. The machine according to claim 1 wherein the threads of said first and second threaded holes are both either a right hand thread or a left hand thread.

5. In a machine for applying a terminal, taken from a strip of terminals, to the end of an electrical conductor in a workstation, wherein said machine includes a feed track and said strip of terminals is moved along said feed track toward said workstation, a terminal feed mechanism comprising:

(a) a support member arranged to move in a first direction parallel with said movement of said strip of terminals and in an opposite second direction;

(b) a pawl pivotally attached at one end to said support member and having a terminal engaging tooth at another end thereof;

(c) first actuator means attached to said frame for effecting said movement of said support member in said first and second directions; and (d) second actuator means carried by said support member for effecting pivotal movement of said pawl so that said tooth is in engagement with a terminal of said strip of terminals while said first actuator means effects said movement of said support member in said first direction, and for effecting opposite pivotal movement of said pawl so that said tooth disengages said terminal and is spaced from said strip of terminals while said first actuator means effects said movement of said support means in said second direction, wherein said second actuator means is a pneumatic cylinder having its frame pivotally mounted to said second end of said support member and including a feed dog actuating lever having a first end rigidly attached to said feed dog and a second end thereof pivotally attached to the piston rod of said cylinder.

6. The machine according to claim 5 wherein said pivotal attachment of said second end of said feed dog actuating lever to said piston rod is effected by means of:

(a) a slot formed in said second end of said lever having an axis substantially parallel with said first and second directions;

(b) a pin in a slip fit hole through said second end of said lever intersecting said slot, the axis of said pin being perpendicular to said axis of said slot, wherein the end of said piston rod extends into said slot and is threaded into a threaded hole in said pin.

7. The machine according to claim 5 wherein said second end of said support member includes a slot formed therein having its axis substantially parallel with said first and second directions, said piston rod of said second actuator means extending completely through said slot, and said frame thereof having a pair of flanges that straddle said other end of said support member, said pair of flanges being pivotally attached to said support member on opposite sides of said slot.

* * * * *